United States Patent [19]

Hall et al.

[11] Patent Number: 4,498,871

[45] Date of Patent: * Feb. 12, 1985

[54] HYDRAULIC SYSTEM FOR MARINE PROPULSION DEVICE WITH SEQUENTIALLY OPERATING TILT AND TRIM MEANS

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[ * ] Notice: The portion of the term of this patent subsequent to Jul. 26, 2000 has been disclaimed.

[21] Appl. No.: 446,351

[22] Filed: Dec. 2, 1982

Related U.S. Application Data

[63] Continuation-in-part of Ser. No. 252,813, Apr. 10, 1981, Pat. No. 4,395,239, and a continuation-in-part of Ser. No. 183,209, Sep. 2, 1980, Pat. No. 4,363,629.

[51] Int. Cl.[3] ..... B63H 5/12

[52] U.S. Cl. ..... 440/61

[58] Field of Search ..... 440/56, 58–63, 440/65, 53; 91/420, 515–517; 60/473, 476

[56] References Cited

U.S. PATENT DOCUMENTS 4,064,824 12/1977 Hall et al. ..... 440/61

4,395,239 7/1983 Hall et al. ..... 440/61

*Primary Examiner*—Sherman D. Basinger

*Attorney, Agent, or Firm*—Michael, Best & Friedrich

[57] ABSTRACT

Disclosed herein is a marine propulsion device comprising a first pivot connecting a stern bracket to a transom bracket for pivotal movement therebetween about a first pivot axis which is horizontal when the transom bracket is boat mounted, a second pivot connecting the swivel bracket to the stern bracket for pivotal movement of the swivel bracket with the stern bracket and relative to the stern bracket about a second pivot axis parallel to the first pivot axis, a propulsion unit including, at the lower end thereof, a rotatably mounted propeller and connected to the swivel bracket for steering movement therebetween and for common pivotal movement, a trim cylinder-piston assembly pivotally connected to the stern bracket and to the swivel bracket and including first and second ends, a tilt cylinder-piston assembly pivotally connected to the transom bracket means and to the stern bracket and including first and second ends, and a hydraulic system for sequentially operating the tilt and trim cylinder-piston assemblies.

12 Claims, 6 Drawing Figures

HYDRAULIC SYSTEM FOR MARINE PROPULSION DEVICE WITH SEQUENTIALLY OPERATING TILT AND TRIM MEANS

RELATED APPLICATIONS

This application is a continuation-in-part of U.S. Pat. Ser. No. 252,813 filed April 10, 1981 now U.S. Pat. No. 4,395.239, issued July 26, 1983 and entitled HYDRAULIC SYSTEM FOR MARINE PROPULSION DEVICE WITH SEQUENTIALLY OPERATING TILT & TRIM MEANS and U.S. Pat. Ser. No. 183,209 filed Sept. 2, 1980, now U.S. Pat. No. 4,363,629 issued Dec. 14, 1982, and entitled HYDRAULIC SYSTEM FOR OUTBOARD MOTOR WITH SEQUENTIALLY OPERATING TILT AND TRIM MEANS.

Reference is hereby also made to the following related U.S. patents, all of which are assigned to the assignee of this application and all of which are incorporated herein by reference:

Stevens U.S. Pat. No. 4,355,986, issued Oct. 26, 1982, and entitled OUTBOARD MOTOR WITH ELEVATED HORIZONTAL PIVOT AXIS.

Blanchard U.S. Pat. No. 4,406,632, issued Sept. 27, 1983, and entitled OUTBOARD MOTOR WITH DUAL TRIM AND TILT AXIS.

Hall et al U.S. Pat. No. 4,373,920 issued Feb. 15, 1983, and entitled MARINE PROPULSION DEVICE STEERING MECHANISM.

Hall et al U.S. Pat. No. 4,354, 848 issued Oct. 19, 1982, and entitled OUTBOARD MOTOR WITH TILT LINKAGE INCLUDING PIVOT LINK.

Hall et al U.S. Pat. No. 4,373,921 issued Feb. 15, 1983, and entitled OUTBOARD MOTOR WITH SEQUENTIALLY OPERATING TILT AND TRIM MEANS.

Hall et al U.S. Pat. No. 4,362,513 issued Dec. 7, 1982, and entitled DUAL PIVOT OUTBOARD MOTOR WITH TRIM AND TILT TOGGLE LINKAGE.

Hall et al U.S. Pat. No. 4,384,856, issued May 24, 1983, and entitled LATERAL SUPPORT ARRANGEMENT FOR OUTBOARD MOTOR WITH SEPARATE TILT AND TRIM AXIS.

Blanchard U.S. Pat. No. 4,406,634, issued Sept. 27,1983, and entitled OUTBOARD MOTOR WITH STEERING ARM LOCATED AFT OF TRANSOM AND BELOW TILT AXIS.

BACKGROUND OF THE INVENTION

The invention relates generaly to marine propulsion devices and, more particularly, to outboard motors including propulsion units which are steerable in a horizontal plane and tiltable in a vertical plane.

The invention also relates to hydraulic systems for power tilting of propulsion units between a lower normal running position in which the propeller is submerged in water, and a tilted or raised position in which the propeller is located for above-the-water-accessibility. Still more particularly, the invention relates to let-down of the propulsion unit after the striking of an underwater obstacle.

Various arrangements for power tilting and/or trimming of marine propulsion units are set forth in the following U.S. patents:

| | | |
|---|---|---|
| Carpenter | 3,722,455 | March 27, 1973 |
| Shimanckas | 3,847,108 | November 12, 1974 |
| Borst | 3,863,592 | February 4, 1975 |

-continued

| | | |
|---|---|---|
| Borst | 3,885,517 | May 27, 1975 |
| Hall | 3,983,835 | October 5, 1976 |
| Hall | 4,064,824 | December 27, 1977 |
| Hall | 4,096,820 | June 27, 1978 |
| Pichl | 4,177,747 | December 11, 1979 |

SUMMARY OF THE INVENTION

The invention provides a marine propulsion device comprising transom bracket means adapted to be connected to a boat transom, a stern bracket, first pivot means connecting the stern bracket to the transom bracket means for pivotal movement therebetween about a first pivot axis which is horizontal when the transom bracket means is boat mounted, a swivel bracket, second pivot means connecting the swivel bracket to the stern bracket for pivotal movement with the stern bracket and relative to the stern bracket about a second pivot axis parallel to the first pivot axis, a propulsion unit including, at the lower end thereof, a rotatably mounted propeller, means pivotally connecting the propulsion unit to the swivel bracket for steering movement relative to the swivel bracket and for common pivotal movement with the swivel bracket, a trim cylinder-piston assembly pivotally connected to the stern bracket and to the swivel bracket and including first and scond ends, a tilt cylinder-piston assembly pivotally connect to the transom bracket means and to the stern bracket and including first and second ends, a reversible pump including first and second ports, first conduit means including first valve means communicating between the first pump port and the first end of the trim cylinder-piston assembly, second conduit means including second valve means communicating between the first pump port and the first end of the tilt cylinder-piston assembly, third conduit means including third valve means dividing the third conduit means into an upstream portion communicating with the second pump port and a downstream portion communicating with the second end of the trim cylinder-piston assembly, fourth conduit means including fourth valve means dividing the fourth conduit means into an upstream portion communicating with the second pump port and a downstream portion communicating with the second end of the tilt cylinder-piston assembly, and let-down means communicating between the sump and the downstream portion of one of the third and fourth conduit means and including a let-down valve preventing flow from the sump to the downstream portion of the one of the third and fourth conduit means and selectively permitting flow from the downstream portion of the one of the third and fourth conduit means to the sump, and means for selectively opening the let-down valve including a piston engageable with the let-down valve, and a duct communicating between the piston and the second conduit means and including therein valve means preventing flow to the second conduit means and permitting flow from the second conduit means to the piston in response to pressure in the second conduit means above a predetermined level.

The invention also provides a marine propulsion device comprising transom bracket means adapted to be connected to a boat transom, a stern bracket, first pivot means connecting the stern bracket to the transom bracket means for pivotal movement therebetween about a first pivot axis which is horizontal when the transom bracket means is boat mounted, a swivel bracket, second pivot means connecting the swivel bracket to the stern bracket for pivotal movement with the stern bracket and relative to the stern bracket about a second pivot axis parallel to the first pivot axis, a propulsion unit including, at the lower end thereof, a rotatably mounted propeller, means pivotally connecting the propulsion unit to the swivel bracket for steering movement relative to the swivel bracket and for common pivotal movement with the swivel bracket, a trim cylinder-piston assembly pivotally connected to the stern bracket and to the swivel bracket and including first and second ends, a tilt cylinder-piston assembly pivotally connect to the transom bracket means and to the stern bracket and including first and second ends, a reversible pump including first and second ports, first conduit means including first valve means communicating between the first pump port and the first end of the trim cylinder-piston assembly, second conduit means including second valve means communicating between the first pump port and the first end of the tilt cylinder-piston assembly, third conduit means including third valve means dividing the third conduit means into an upstream portion communicating with the second pump port and a downstream portion communicating with the second end of the trim cylinder-piston assembly, fourth conduit means including fourth valve means dividing the fourth conduit means into an upstream portion communicating with the second pump port and a downstream portion communicating with the second end of the tilt cylinder-piston assembly, additional conduit means extending between the first and second conduit means and including valve means for preventing flow from the second conduit means to the first conduit means and permitting flow from the first conduit to the second conduit means in response to pressure in the first conduit means above a predetermined level.

Other features and advantages of the embodiments of the invention will become known by reference to the following general description, claims and appended drawings.

IN THE DRAWINGS

Figure 1:
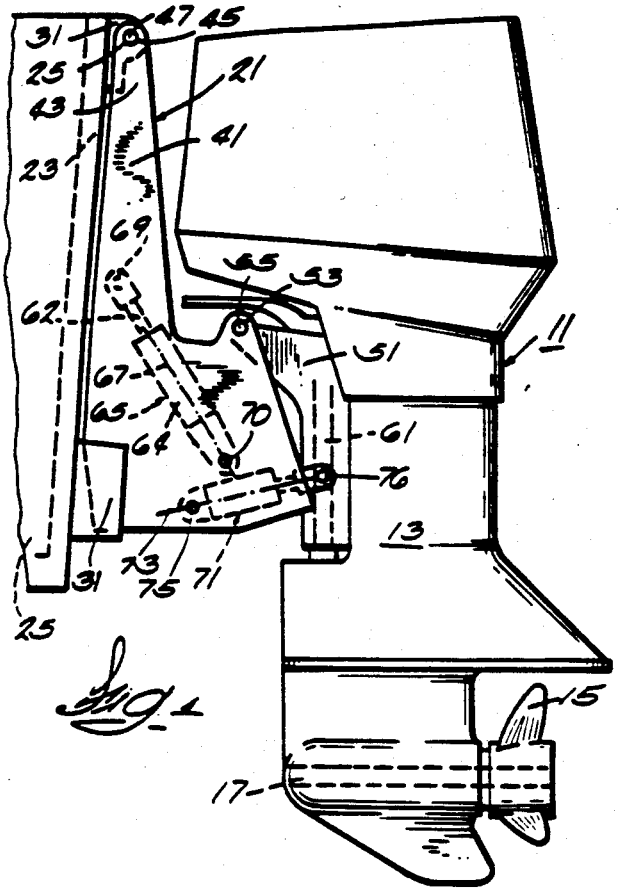
FIG. 1 is a side elevational view of an outboard motor incorporating various of the features of the invention.

Before explaining one embodiment of the invention in detail, it is to be understood that the invention is not limited in its application to the details of contruction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device in the form of an outboard motor 11 having a generally conventional propulsion unit 13 including, at the lower end thereof, a rotatably mounted propeller 15 driven by a propeller shaft 17. The outboard motor 11 also includes means 21 for pivotally mounting the propulsion unit 13 for pivotal movement in both the horizontal and vertical planes relative to a transom 23 of a boat 25, whereby to provide for steering movement of the propulsion unit 13 in the horizontal plane, and to provide for movement in the vertical plane of the propulsion unit 13 between a lowermost position with the propeller 15 fully submerged in water for driving propulsion and a raised position affording above-water accessibility to the propeller 15.

The means 21 for pivotally mounting the propulsion unit 13 includes a transom bracket means 31 which can be of unitary construction, or which can comprise several parts, and which is adapted to be fixedly mounted on the transom 23 of the boat 25.

The means 21 for pivotally mounting the propulsion unit 13 also includes a stern bracket 41 having an upper end 43, as well as first or upper pivot means 45 located rearwardly of the boat transom 23 and connecting the upper end 43 of the stern bracket 41 to the transom bracket means 31 for pivotal movement of the stern bracket 41 about a first or upper pivot axis 47 which is horizontal when the transom bracket means 31 is boat mounted. Any means for effecting such pivotal connection can be employed.

The means 21 for pivotally mounting the propulsion unit 13 further includes a swivel bracket 51, together with a lower or second pivot means 53 connecting the swivel bracket 51 to the stern bracket 41 at a point below the first pivot means 45 for pivotal movement of the swivel bracket 51 relative to the stern bracket 41 about a second or lower pivot axis 55 which is parallel to the first or upper pivot axis 47. Any means for effecting such pivotal connection can be employed.

The means 21 for pivotally mounting the propulsion unit 13 further includes means 61 for pivotally connecting the propulsion unit 13 to the swivel bracket 51 for movement in common with the swivel bracket 51 about the first and second or upper and lower pivot axes 47 and 55 and for steering movement of the propulsion unit 13 about a generally vertical axis relative to the swivel bracket 51. Any suitable means can be provided for pivotally connecting the swivel bracket 51 and the propulsion unit 13 and any suitable means can be employed for effecting steering displacement in a horizontal plane of the propulsion unit 13 relative to the swivel bracket 51.

The outboard motor 11 also includes means for displacing the swivel bracket 51 and connected propulsion unit 13 about the lower horizontal pivot axis 55 and about the upper horizontal pivot axis 47. In the construction illustrated in FIG. 1, such means comprises one or more tilt hydraulic cylinder-piston assemblies 65, each having an axis 67 and opposed ends 69 and 70. One end 69 is pivotally connected, by any suitable means, to the transom bracket means 31 and the other end 70 is pivotally connected, by any suitable means, to the stern bracket 41.

Figure 2:
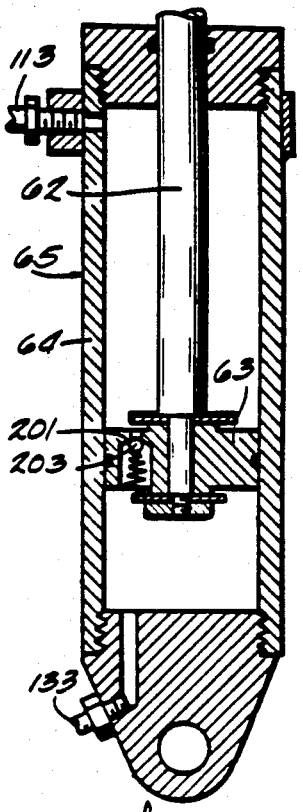
FIG. 2 is an enlarged cross-sectional view of the tilt cylinder-piston assembly incorporated in the outboard motor shown in FIG. 1.

While other arrangements could be employed, in the disclosed construction, the tilt cylinder-piston assembly 65 comprises (as shown best in FIG. 2) a tilt piston rod 62 having a first end pivotally connected to one of the stern bracket 41 and the transom bracket means 31, a tilt piston 63 fixed to the other or second end of the tilt piston rod 62, and a tilt cylinder 64 receiving the tilt piston 63 and having a first or rod end through which the tilt piston rod 62 passes and a second or blind end pivotally connected to the other of the stern bracket 41 and the transom bracket means 31. In the disclosed construction, the piston rod is pivotally connected to the transom bracket means 31 and the second or blind end of the cylinder 64 is pivotally connected to the stern bracket 41.

In addition, the means for pivotally displacing the swivel bracket 51 and connected propulsion unit 13 includes one or more trim cylinder-piston assemblies 71, each having an axis 73 and opposed ends 75 and 76. One end 75 is pivotally connected, by any suitable means, to the stern bracket 41, and the other end 76 is pivotally connected, by any suitable means, to the swivel bracket 51.

Figure 3:
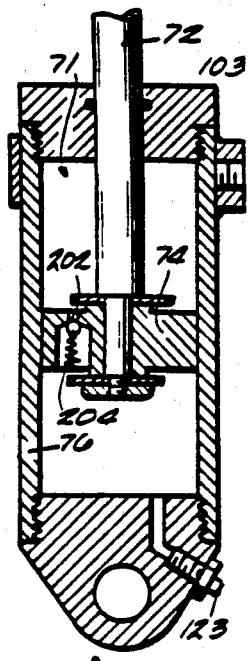
FIG. 3 is an enlarged cross-sectional view of the trim cylinder-piston assembly incorporated in the outboard motor shown in FIG. 1.

While other arrangements are possible, in the disclosed construction, the trim cyliner-piston assembly 71 includes (as shown best in FIG. 3) a trim piston rod 72 having a first end pivotally connected to the swivel bracket 51, a trim piston 74 fixed on the other or second end of the trim piston rod 72, and trim cylinder 76 receiving the trim piston and having a first or rod end through which the trim piston rod 72 passes and a second or blind end pivotally connected to the stern bracket 41.

In order provide for sequential upward pivotal propulsion unit movement through the trim range and then through the tilt range when under thrust conditions, the pivotal connections of the trim cylinder-piston assembly 71 and the tilt cylinder-piston assembly 65 are located such that, when the swivel bracket 51 and connected propulsion unit 13 are in the lowermost position, the ratio of the perpendicular distances from the lower or second pivot axis 55 to the axis of the propeller 15 and to the axis 73 of the trim cylinder-piston assembly 71 is less than the ratio of the perpendicular distances from the upper or first horizontal axis 47 to the axis of the propeller 15 and to the axis 67 of the tilt cylinder-piston assembly 65.

More specifically, it is noted that the moment arm between the upper pivot or tilt axis 47 and axis 67 of the tilt cylinder-piston assembly 65 is several times less than (approximately 20 percent of) the moment arm from the upper pivot or tilt axis 47 to the axis of the propeller 15. It is also noted that the moment arm from the lower pivot or trim axis 55 to the axis 73 of the trim cylinder-piston assembly 71 is less than (approximately 40 percent of) the moment arm from the lower pivot or trim axis 55 to the axis of the propeller 15. Thus, if the cross sectional dimension of the trim and tilt cylinder-piston assemblies 65 and 71 are about the same, substantially greater pressures are developed in the tilt cylinder-piston 65 assembly as compared to the trim cylinder-piston assembly 71 in response to propulsive thrust developed by the propeller 15.

Also included in the means for displacing the swivel bracket 51 and connected propulsion unit 13 about the upper and lower horizontal pivot axes 47 and 55, respectively, is (see especially FIG. 4) a source of pressure fluid 81 and a fluid conduit system 83. The source of pressure fluid 81 includes a reversible electric pump 85 having opposed first and second side ports 87 and 89 which alternately act as inlet and outlet ports depending upon the direction of pump rotation. The source of pressure fluid 81 communicates through the fluid conduit system 83 with a sump 92, which fluid conduit system 83 includes a first duct 94 including check valve means 96 permitting fluid flow therethrough from the sump 92 to the first side port 87 of the pump 85 and preventing reverse flow, and a second duct 98 including check valve means 100 permitting fluid flow therethrough from the sump 92 to the other or second side port 89 of the pump 85 and preventing reverse flow. If desired the duct 98 and check valve 100 can be omitted, but their inclusion serves to prevent pump cavitation. If desired a filter 90 can be employed between the sump 92 and the ducts 94 and 98.

The fluid conduit system 83 also connects the source of pressure fluid 81 to the tilt and trim, cylinder-piston assemblies 65 and 71, respectively. In this regard, the fluid conduit system 83 includes, in general, first, second, third, fourth and fifth conduit means 91, 93, 95, 97, and 99, respectively.

The first conduit means 91 includes first check valve means 101 dividing the first conduit means 91 into an upstream portion communicating with the first pump port 87 and a downstream portion 103 communicating with the first or rod end of the trim cylnder-piston 71, which first check valve means 101 is yieldably biased by a spring 105 to the closed position and is operative to permit flow from the upstream portion to the downstream portion 103 in response to the presence of fluid under pressure at the first pump port 87 and to permit flow from the downstream portion 103 to the upstream portion in response to the prsence of fluid under pressure at the second pump port 89.

The second conduit means 93 includes second check valve means 111 dividing the second conduit means 93 into an upstream portion communicating with the first pump port 87 and a downstream portion 113 communicating with the first or rod end of the tilt cylinder-piston assembly 65, which second check valve means 111 is yieldably biased by a spring 115 to the closed position and is operative to permit flow from the upstream portion to the downstream portion 113 in response to the resence of fluid under pressure at the first pump port 87, and to permit flow from the downstream portion 113 to the upstream portion in response to the presence of fluid under pressure at the second pump port 89.

The third conduit means 95 includes third check valve means 121 dividing the third conduit means 95 into an upstream portion communicating with the second pump port 89 and a downstream portion 123 communicating with the second or blind end of the trim cylinder-piston assembly 71, which third check valve means 121 is yieldably biased by a spring 125 to the closed position and is operative to permit flow from the upstream portion to the downstream portion 123 in response to the presence of fluid under pressure at the second pump port 89, and to permit flow from the downstream portion 123 to the upstream portion in response to the presence of fluid under pessure at the first pump port 87.

The fourth conduit means 97 includes fourth check valve means 131 dividing the fourth conduit means 97 into an upstream portion communicating with the second pump port 89 and a downstream portion 133 communicating with the second or blind end of the tilt cylinder-piston assembly 65, which fourth check valve means 131 is yieldably biased by a spring 135 to the closed position and is operative to permit flow from the upstream portion to the downstream portion 131 in response to the presence of fluid under pressure at the second pump port 89.

The fifth conduit means 99 includes fifth combined check and pressure relief valve means 141 communicating between the downstream portion 123 of the third conduit means 95 and the downstream portion 133 of the fourth conduit means 97, which fifth check valve means 141 is biased closed by a spring 145 and is operable to prevent fluid flow from the downstream portion 123 of the third conduit means 95 to the downstream portion 133 of the fourth conduit means 97, and to permit fluid flow from the downstream portion 133 of the fourth conduit means 97 to the downstream portion 123 of the third conduit means 95 in response to the presence of fluid under pressure at a predetermined level in the downstream portion 133 of the fourth conduit means 97. The springs 105, 115, 125, 135 and 145 biasing the check valves 105, 111, 121, 131, and 141, are relatively light and, accordingly, in the absence of back pressure on these valves, little force is necessary to open them. In this last regard, in the disclosed construction, the fifth valve means is set to open at about 20 p.s.i.

Means are provided for opening the normally closed check valves 111 and 121 in the second and third conduit means 93 and 95 in response to pump operation. In this regard, a control piston 151 is located in a control cylinder 153 and includes axially extending pins 155 and 157 which, in response to piston movement in the control cylinder 153, are respectively engageable with the normally closed valves 111 and 121 for opening thereof.

Means are also provided for opening the normally closed check valve 101 in the first conduit means 91 in response to pump operation. In this regard, a control piston 161 is located in a control cylinder 163 and, at one end, includes an axially extending pin 165 which, in response to piston movement in the control cylinder 163, is engageable with the normally closed check valve 101 in the first conduit means 91 for opening thereof.

The control cylinders 153 and 163 communicate at their opposite ends, with the upstream portions of the first, second, third, and fourth conduit means 91, 93, 95, and 97 and with the side ports 87 and 89 of the pump 85. Thus, when the side port 87 is pressurized by the pump 85, the piston 151 moves to the right to open the normally closed check valve 121 in the third conduit means 95 so as thereby to enable drainage of fluid from the blind end of the trim cylinder-piston assembly 71 through the conduit means 95. Simultaneously, fluid under pressure at the side port 87 of the pump 85 acts, through the control cylinders 153 and 163, to open the normally closed valves 101 and 111 in the first and second conduit means 91 and 93 so as to enable supply of fluid under pressure through the conduit means 91 and 93 to the rod ends of the tilt and trim cylinder-piston assemblies 65 and 71. At the same time, the fourth check valve means 131 remains closed and drainage of fluid through the fourth conduit 97 from the blind end of the tilt cylinder-piston assembly 65 occurs when the pressure therein rises above the level set at the fifth check valve means 141.

When the side port 89 is pressurized by the pump 85, fluid under pressure serves to displace the pistons 151 and 161 to the left so as to open the normally closed check valve means 101 and 111 in the first and second conduit means 91 and 93 so as thereby to enable drainage of fluid through the conduits 91 and 93 from the rod ends of the tilt and trim cylinder-piston assemblies 65 and 71. At the same time, the fluid under pressure in the control cylinder 153 operates to open the normally closed check valve means 121 in the third conduit means 95 so as to enable supply of pressure fluid through the conduit 95 to the blind end of the trim cylinder-piston assembly 65. Simultaneously, such fluid under pressure at the side port 89 opens the fourth check valve means 131 so as to enable supply of fluid under pressure through the fourth conduit means 97 to the blind end of the tilt cylinder-piston assembly 65.

In order to permit upward movement of the propulsion unit 13 in response to the striking of an underwater obstacle, the tilt piston 63 includes therein (See FIG. 2) an orifice (or orifices) 201 and a spring biased check or pressure relief valve (or valves) 203 which opens in response to substantially increased pressure at the rod end of the tilt cylinder 64 so as to permit flow from the rod end of the tilt cylinder 64 to the blind end of the tilt cylinder 64. Such movement of the fluid in the tilt cylinder 64 through the orifice 201 serves to permit extension of the tilt cylinder-piston assembly 65 and to absorb energy during rapid upward swinging movement of the propulsion unit 13 in response to the striking of an underwater obstacle.

Also in connection with upward movement of the propulsion unit 13 in response to the striking of an underwater obstacle, the trim piston 74 includes therein (See FIG. 3) an orifice (or orifices) 202 and a spring biased check or pressure relief valve (or valves) 204 which opens in response to substantially increased pressure at the rod end of the trim cylinder 76 so as to permit flow from the rod end of the trim cylinder 76 to the blind end. Such movement of the fluid in the trim cylinder 76 through the orifice 202 serves to permit extension of the trim cyliner-piston assembly 71 and to absorb energy during rapid upward swinging movement of the propulsion unit 13 in response to the striking of an underwater obstacle.

The pressure settings of the check or pressure relief valves 201 and 202 also can prevent hydraulic lock-up at the rod ends of the tilt and trim cylinders 64 and 76, when the tilt and trim cylinder-piston assemblies 65 and 71 are fully contracted and the pump 85 is deenergized, by permitting fluid flow from the rod end to the blind end of the associated cylinder.

The fluid conduit system 83 also includes a manual release valve 211 which allows free travel of the tilt and trim cylinder-piston assemblies 65 and 71. The release valve 211 is sequentially operable to connect the downstream portion 113 of the second conduit means 93 through branch ducts 213 and 215 to the downstream portion 123 of the third conduit means 95 and then to additionally connect the downstream portion 113 of the second conduit means 93 through branch duct 217 with the downstream portion 133 of the fourth conduit means 97, while retaining communication between the second conduit means 93 and the third conduit means 95.

The manual release valve 211 includes a threaded valve member 219 which, in response to rotation thereof, is movable axially in a housing 221 and relative to the adjacent end of the branch duct 215. When in the fully closed position shown in FIG. 4, the end of the valve member 219 closes the branch duct 215 so as to prevent flow between the branch duct 213 and the branch duct 215. However, initial outward valve member movement to the left in FIG. 4 serves to displace the end of the valve member 219 away from the branch duct 215 and thereby to permit fluid flow between the branch duct 215, and through an annular space 223 between the end of the valve member 219 and the housing 221, and the branch duct 213. Further outward retraction toward the left in FIG. 4 of the valve member 219 serves to communicate an annular passage 224 forming a part of the branch duct 217 and the annular space 223 around the inner end of the valve member 219, thereby communicating the branch duct 217 with the second conduit means 93.

The fluid conduit system 83 also includes a pressure relief valve 251 which communicates between the first side port 87 of the pump 85 and the sump 92, as well as a pressure relief valve 261 which communicates between the sump 92 and the downstream portion 133 of the fourth conduit means 97. Still further in addition, the fluid conduit system 83 includes a pressure relief value 271 which communicates between the sump 92 and the downstream portion 123 of the third conduit means 95. The pressure relief valves 251 and 261 are set to relieve pressure at a pressure greater than that of the fifth valve means 141, i.e., at about 1,500 p.s.i. in the disclosed embodiment, and the pressure relief valve 271 is set at a pressure higher than the pressure relief valves 251 and 261, i.e., at about 2,500 p.s.i. in the disclosed embodiment.

In operation as thus far disclosed, when the pump 85 is not energized, the check valves 101, 111, 121 and 131 are operative to prevent fluid flow in the system 83 and therefore to lock the trim and tilt cylinder piston assemblies 65 and 71 in their existing postions.

In the event of the striking of an underwater obstacle when moving in the forward direction, and with the pump 85 deenergized, the pressures exerted on the propulsion unit 13 will cause fluid flow through the orifice 201 in the tilt piston 63 from the rod end to the blind end of the tilt cylinder 64, and through the orifice 202 in the trim piston 74 from the rod end to the blind end of the trim cylnder 76, thereby permitting upward swinging of the stern bracket 41 and swivel bracket 51 relative to the transom bracket means 31.

In order to permit the return of the propulsion unit 13 to a position in the water after the striking of an underwater obstacle, let-down means 225 are provided for permitting escape of fluid from the blind or lower end of the tilt cylinder-piston assembly 65. In this regard, and as shown in FIG. 4 there is provided a vent or branch duct or conduit 227 which communicates between the downstream portion 133 of the fourth conduit means 97 and the sump 92 and which includes valve means comprising a port 231 providing a valve seat, a valve member 233 movable relative to the port or valve seat 231, and a spring 235 which biases the valve member 233 to the closed position so as to normally prevent flow from the downstream portion 133 of the fourth conduit means 97 to the sump 92.

The let-down means 225 also includes a piston 237 movable in a let-down cylinder 239 and including a projection 241 which, in response to piston movement, is movable into and through the port 231 to displace the valve member 233 from the valve seat 231 and thereby to open the branch conduit. In addition, the let-down means 225 also includes a duct or conduit 243 which communicates between the second conduit means 93 and the piston 237 and which includes a check valve 245 which prevents flow to the second conduit means 93 and which permits flow from the second conduit means 93 to the piston 237 when the pressure in the second conduit means 93 is above a predetermined limit. Such pressure will occur when the fluid in the rod end of the tilt cylinder-piston assembly 65 is pressurized incident to extension of the tilt cylinder-piston assembly 65 occurring in response to sudden upward tilting of the propulsion unit 13 occurring in response to the striking of an underwater obstacle.

Figure 4:
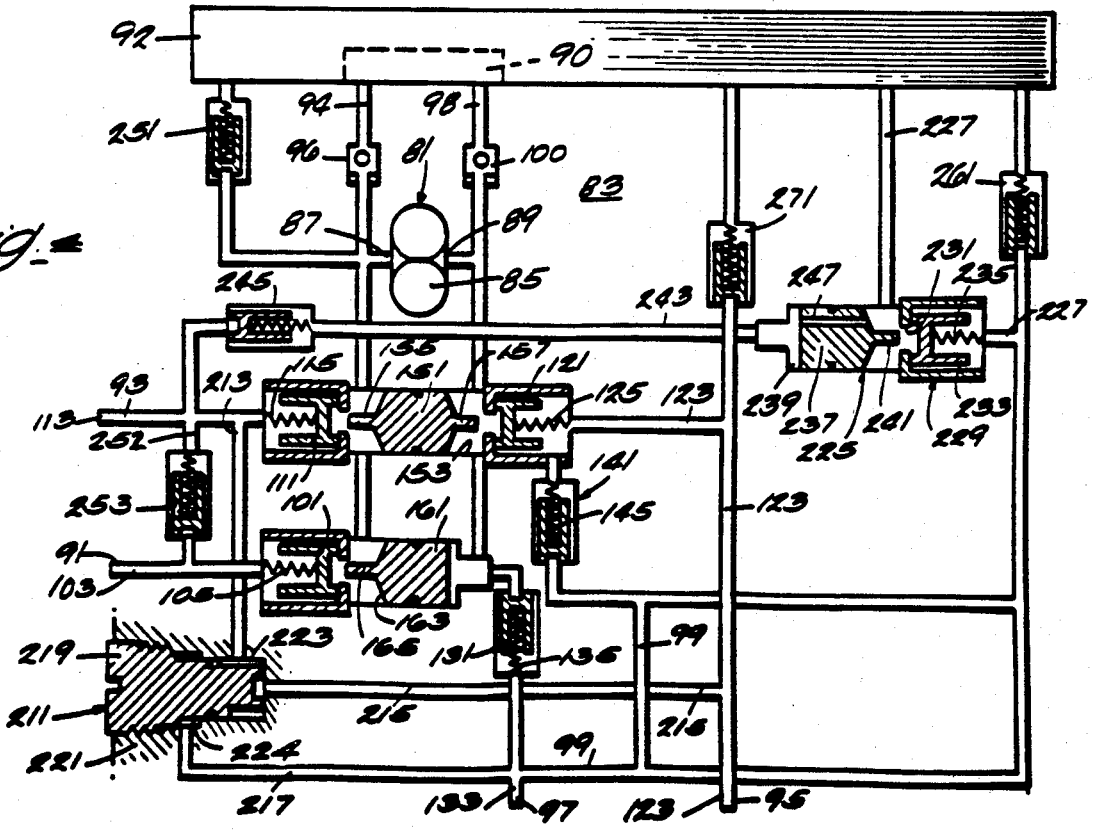
FIG. 4 is a schematic view of the pressure fluid supply and conduit system included in the outboard motor shown in FIG. 1.

Such pressure exerted against the piston 237 forces the piston 237 to the right in FIG. 4 so as to engage the projection 241 with the valve member 233 so as to displace the valve member 233 from the valve seat or port 231, thereby opening the vent or branch conduit 227 to permit drainage of fluid from the blind end of the tilt cylinder 64 to the sump 92, thereby permitting down movement of the propulsion unit 13 under the influence of gravity and without accuating the pump 85.

Preferably, the piston also includes an axial groove 247 which permits slow escape of fluid from behind the piston 237 to the branch duct 227 so as to enable the spring 235 to reclose the valve member 233 after a time interval permitting the desired drainage of fluid from the blind end of the tilt cylinder 64.

In order to prevent build up of pressure in the rod end of the trim cylinder 76 to a level greater than the pressure in the rod end of the tilt cylinder 64, and thereby to further assure proper sequencing of the tilt down and trim in operation, there is also provided a connecting conduit 252 which joins the first and second conduit means 91 and 93, which includes a pressure regulation check valve 253, which prevents flow from the second conduit means 93 to the first conduit means 91, and which permits flow from the first conduit means 91 to the second conduit means 93 in response to a pressure above a predetermined level in the rod end of the trim cylinder-piston assembly 71. Such pressure can also be utilized to operate the let-down valve means 225 so as to permit downswinging of the propulsion unit through the tilt range to the lowermost trim position.

Figure 5:
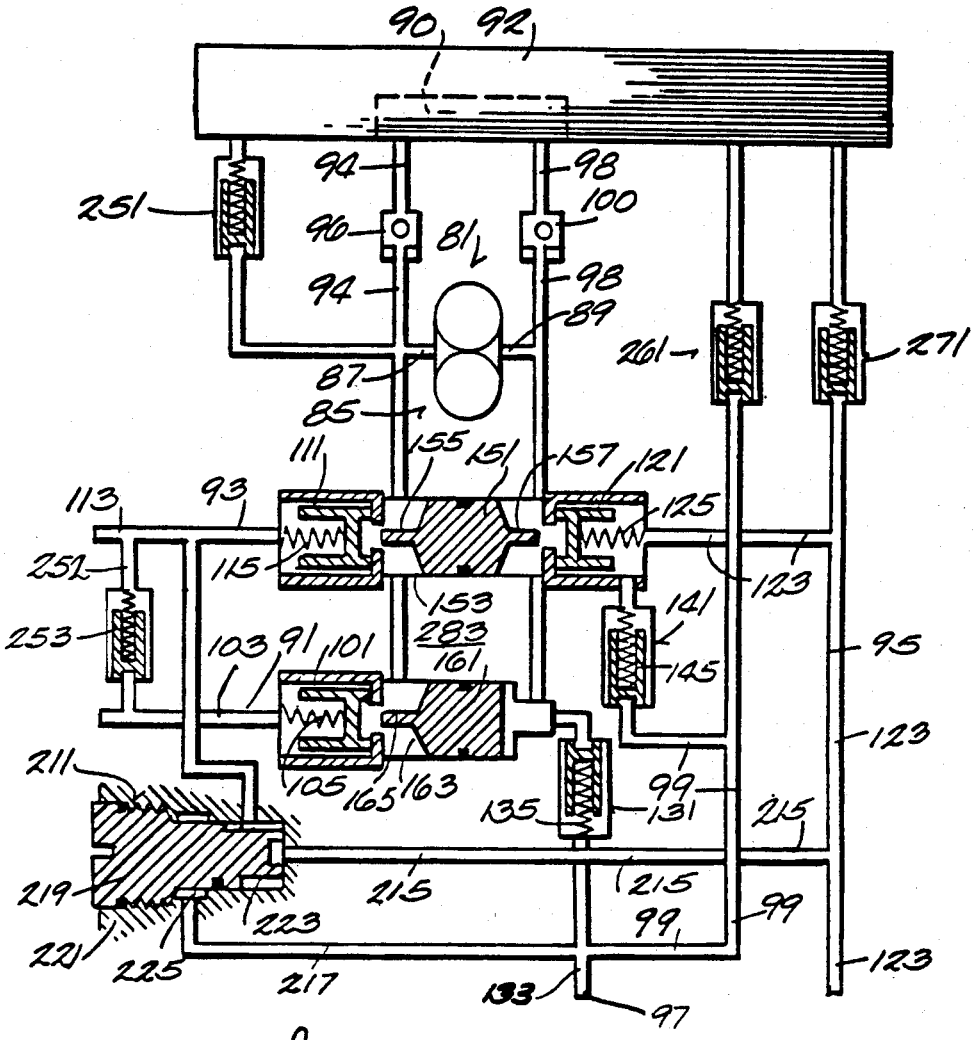
FIGS. 5 and 6 are schematic views of modified pressure fluid supply and conduit systems.

If it is desired to omit gravity return of the propulsion unit 13 to the water and to place reliance on pump operated return of the propulsion unit 13, a fluid conduit system 283 which is similar to the system 83 shown in FIG. 4 and which is shown in FIG. 5 can be employed. In the system 283 shown in FIG. 5, the let-down means 225 has been omitted.

Under forward thrust conditions, actuation of the pump 85 to cause upward swinging movement of the propulsion unit 13 will apply equal lifting force at both the trim and tilt cylinder assemblies 65 and 71 (assuming that the tilt and trim cylinders 64 and 76, respectively, are of equal diameter or that the tilt cylinder 64 is smaller than the trim cylinder 76). Accordingly, because of geometric considerations, the trim cylinder-piston assembly 71 will first extend through the trim range and, thereafter, the tilt cylinder-piston assembly 65 will extend through the tilt range.

With respect to energization of the pump 85 to obtain down swinging movement of the propulsion unit 13 under forward thrust conditions, and assuming the diameters of the tilt and trim cylinders 64 and 76, respectively, are equal or that the tilt cyliner 64 is smaller than the trim cylinder 76, because of geometric considerations, the tilt cylinder-piston assembly 65 will first contract, followed by contraction of the trim cylinder-piston assembly 71 after full contraction of the tilt cylinder-piston assembly 65.

Referring to reverse thrust operation when the pump 85 is deactivated, such reverse thrust tends to swing the propulsion unit 13 upwardly and thereby causes pressure buildup at the rod end of the tilt and trim cylinders 64 and 76. Because of geometric considerations, i.e., because the moment arm to the tilt cylinder 64 is less than the movement arm to the trim cylinder 76, the resulting pressure at the rod end of the tilt cylinder 64 is greater than at the rod end of the trim cylinder 76. When the pump 85 is not actuated, the check valves 101, 111, 121 and 131 serve to prevent flow to or from tilt and trim cylinders 64 and 76, respectively, and thereby hold the tilt and trim cyliners 64 and 76 in the previously adjusted position. However, when the pump 85 is actuated to cause upward singing movement of the propulsion unit 13, such operation will tend to cause the control pistons 151 and 161 to move toward the left to open the check valves 111 and 101 so as to permit drainage of fluid from the rod ends of the tilt and trim cylinders 64 and 76, respectively.

Because the pressure at the rod end of the tilt cylinder 64 is greater than the pressure at the rod end of the trim cylinder 76, and because such pressures are applied as back pressures to the check valves 111 and 101, the control piston 161 will initially open the trim cylinder check valve 101, thereby permitting extension of the trim cylinder-piston assembly 71 to displace the propulsion unit 13 through the trim range. Upon full extension of the trim cylinder-piston assembly 71, the pump pressure will build to permit opening of the tilt cylinder check valve 111, thereby permitting extension of the tilt cylinder-piston assembly 65 to displace the propulsion unit 13 through the tilt range. Thus, the trim cylinder-piston assembly 71 first extends, followed by extension of the tilt cylinder-piston assembly 65.

Referring now to actuation of the pump 85 to swing the propulsion unit 13 downwardly during reverse thrust conditions, as already mentioned, reverse thrust tends to swing the propulsion unit 13 upwardly and thus the pump 85 must overcome the pressure conditions at the rod ends of the tilt and trim cylinders 64 and 75, respectively, occasioned by such reverse thrust. As already pointed out, the pressure at the rod end of the trim cylinder 76 is less than the pressure at the rod end of the tilt cylinder 64, and thus application of fluid under pressure to the rod ends of the tilt and trim cylinders 64 and 76 will initially cause contraction of the trim cylinder-piston assembly 71, followed by contraction of the tilt cylinder-piston assembly 65. Thus, operation of the pump 85 to obtain down swinging movement of the propulsion unit 13 during reverse thrust conditions can result in a condition in which the propulsion unit is in a lowered position with the trim cylinder-piston assembly 71 fully retracted and with the tilt cylinder-piston assembly 65 partially extended, just the opposite of the desired condition wherein the tilt cylinder-piston assembly 65 is retained in fully contracted condition until after full extension of the trim cylinder-piston assembly 71.

Significantly, however, when reverse thrust is terminated, and assuming the pump 85 to be deactivated, either the operation of gravity, or a condition of forward thrust, will, because of geometry considerations, cause incrased pressure at the blind end of the tilt cylinder 64 are compared to at the blind end of the trim cylinder 76. The increased pressure at the blind end of the tilt cylinder 64 will, acting through the downstream portion 133 of the fourth conduit means 97 and through the fifth conduit means 99, open the fifth valve means 141 permitting fluid flow from the blind end of the tilt cylinder 64 and sequentially through the fourth, fifth and third conduit means 97, 99 and 95, to the blind end of the trim cylinder 76 and thus causing extension of the trim cylinder-piston assembly 71 and simultaneous retraction of the tilt cylinder-piston assembly 65 until the trim cylinder-piston assembly 71 is fully extended and the tilt cylinder-piston assembly 65 is partially extended or until the tilt cylinder-piston assembly 65 is fully retracted and the trim cylinder-piston assembly 71 is partially extended. Thus the check valve 141 permits reorientation of the extension of the trim and tilt cylinder-piston assemblies 65 and 71 so that the trim cylinder-piston assembly 71 is extended before any extension of the tilt cylinder-piston assembly 65.

Displacement of the propulsion unit 13 from a raised position to a lowered position when the pump 85 is deactivated can be obtained by rearwardly partially withdrawing the valve member 219 to the left in FIG. 4, thus communicating the branch conduits 213 and 215 and thus the second and third conduit means 93 and 95. Under such circumstances, the weight of the propulsion unit 13 will cause development of pressures at the blind end of the tilt and trim cylinder 64 and 76, respectively. Due to geometric considerations, the pressure at the blind end of the tilt cylinder 64 will be greater than the pressure at the blind end of the trim cylinder 76, and such pressure, operating through the fourth conduit means 97 and through the fifth conduit means 99 will open the fifth valve means 141 to permit flow from the blind end of the tilt cylinder-piston assembly 65 through the fifth valve means 141 to the downstream portion 123 of the third conduit means 95, through the branch conduit 215, through the valve 211, through the branch conduit 213, and through the downstream portion 113 of the second conduit means 93 to the rod end of the tilt cylinder 64.

As all of the fluid from the blind end of the tilt cylinder 65 cannot be accommodated at the rod end of the tilt cylinder 64, the tilt-cylinder piston assembly 65 will not be completely contracted when the rod end of the tilt cylinder 64 fills with fluid. At this time, the weight of the propulsion unit 13 is solely carried by the piston rod 62, whereby to substantially increase the pressure on the hydraulic fluid so as to open the pressure relief valve 261 and thereby permit drainage of the remaining fluid from the blind end of the tilt cylinder piston assembly 65 to the sump 92. Thus, partial withdrawal of the valve member 219 permits contraction of the tilt cylinder-piston assembly 65 from the fully extended condition wherein the propulsion unit 13 is in a raised position to the fully contracted position wherein the proulsion unit 13 is in a lowered position.

Further withdrawal of the valve member 219 provides communication between the branch conduits 213 and 217 and therefore directly between the downstream portion 113 of the second conduit means 93 and the downstream portion 133 of the fourth conduit means 97, thereby directly communicating the rod end and the blind end of the tilt cylinder 64 in bypassing relation to the fifth valve means 141. With such direct communication, the propulsion unit 13 can be manually lifted as desired between a lowered position and a raised position.

Complete withdrawal of the valve member 219 from the housing 221 facilitates introduction of the hydraulic fluid into the system 83 from a suitable external source of fluid under pressure.

The pressure relief valve 251 operates, in the event of excessive pressure at the side port 87 of the pump 85 so as to permit return flow from the pump 85 to the sump 92. The pressure relief valve 261 operates, in response to excessive pressure at the side port 89 of the pump 85, or in response to excessive pressure at the blind end of the tilt-cylinder piston assembly 65, to permit return flow of fluid to the sump 92. The valves 251 and 261 thereby prevent pump overload when the propulsion unit 13 is in its lowermost and full tilt positions. The valve 261 also serves to limit the amount of forward thrust which can be carried by the tilt cylinder-piston assembly 65 when the propulsion unit 13 is operating in a shallow water drive condition within the tilt range so as thereby to avoid the possibility of structural damage to the marine propulsion device in the event of excessive thrust. The pressure relief valve 261 also serves to permit return flow to the sump 92 from the blind end of the tilt cylinder 64 when the propulsion unit 13 descends under gravity and when the valve member 219 is partially withdrawn as already explained.

The pressure relief valve 271 operates, in response to pressure in the systems 83 above the level set at the relief valve 261 or in response to excessive pressure at the blind end of the trim cylinder-piston assembly 71 to permit return flow of pressure fluid to sump 92.

Shown in Fi9. 6 is still another embodiment of a fluid conduit system 683 which is similar to the system 83 shown in Fi9. 4 except that the let-down means 225 is arran9ed somewhat differently.

Figure 6:
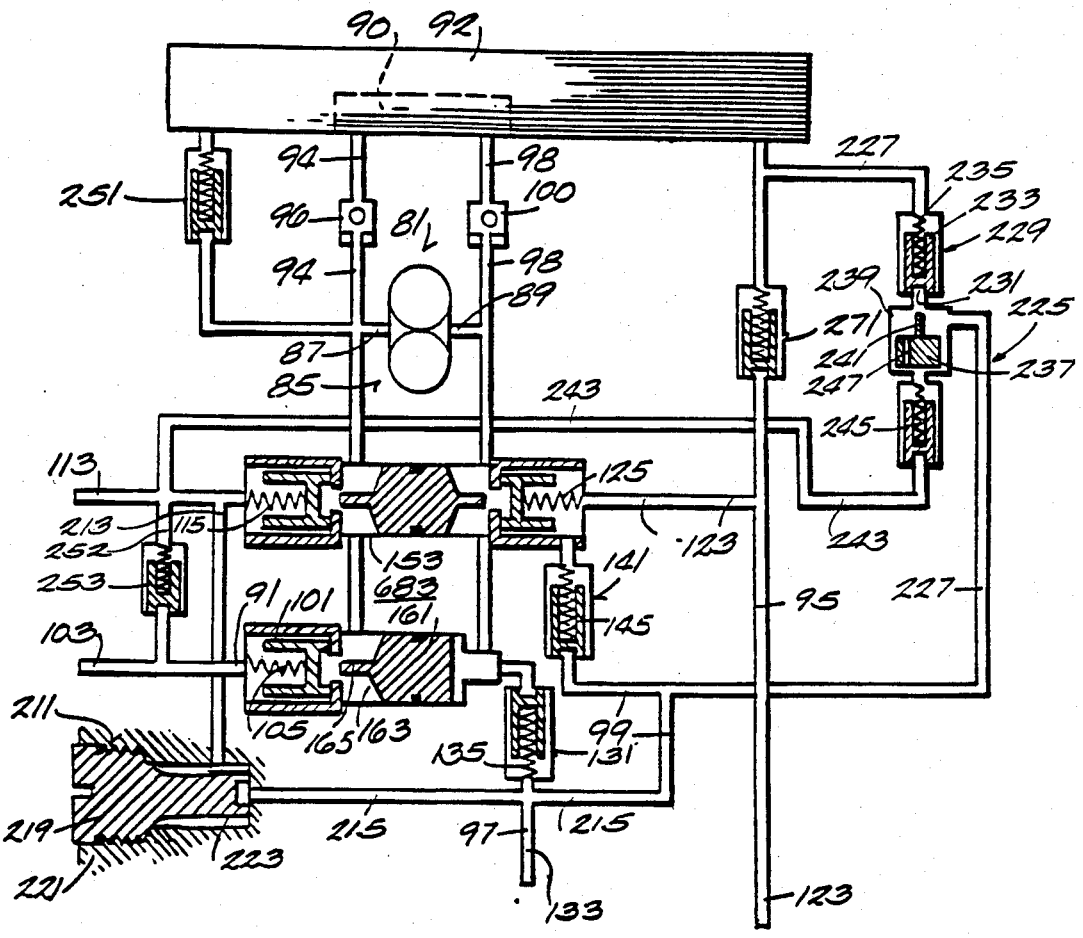

More particularly, in the construction shown in FIG. 6, the functions of the previously described pressure relief valve 261 and the previously described let-down valve 229 are both now performed by the let-down valve 229 due to the re-arrangement.

More specifically, the fluid conduit system shown in FIG. 6 differs from the fluid conduit system 83 shown in FIG. 4 by reason of elimination of the conduit 217, by providing communication between the conduit 215 and the downstream portion 133 of the fourth conduit means 97, by relocation, as already indicated, of the pressure relief valve 261 to additionally function as a part of the let-down means 225, and by arranging the branch duct or vent conduit 227 so as to communicate with the end of the let-down cylinder 239 adjacent the valve port 231, and so as to communicate with the fifth conduit means 99 leading to both the check valve 141 and the downstream portion 133 of the fourth conduit means 97.

As in the other embodiments, the let-down means 225 includes a piston 237 operable in the let-down cylinder 239, as before explained, and a duct 243 which communicates with the let-down cylinder 239 and with the downstream portion 113 of the second conduit means 93 and which includes check valve 245.

Various of the features of the invention are set forth in the following claims.

We claim:

1. A marine propulsion device comprising transom bracket means adapted to be connected to a boat transom, a stern bracket, first pivot means connecting said stern bracket to said transom bracket means for pivotal movement therebetween about a first pivot axis which is horizontal when said transom bracket means is boat mounted, a swivel bracket, second pivot means connecting said swivel bracket to said stern bracket for pivotal movement with said stern bracket and relative to said stern bracket about a second pivot axis parallel to said first pivot axis, a propulsion unit including, at the lower end thereof, a rotatably mounted propeller, means pivotally connecting said propulsion unit to said swivel bracket for steering movement relative to said swivel bracket and for common pivotal movement with said swivel bracket, a trim cylinder-piston assembly pivotally connected to said stern bracket and to said swivel bracket and including first and second ends, a tilt cylinder-piston assembly pivotally connect to said transom bracket means and to said stern bracket and including first and second ends, a reversible pump including first and second ports, first conduit means including first valve means communicating between said first pump port and said first end of said trim cylinder-piston assembly, second conduit means including second valve means communicating between said first pump port and said first end of said tilt cylinder-piston assembly, third conduit means including third valve means dividing said third conduit means into an upstream portion communicating with said second pump port and a downstream portion communicating with said second end of said trim cylinder-piston assembly, fourth conduit means including fourth valve means dividing said fourth conduit means into an upstream portion communicating with said second pump port and a downstream portion communicating with said second end of said tilt cylinder-piston assembly, and let-down means communicating between said sump and said downstream portion of one of said third and fourth conduit means and including a let-down valve preventing flow from said sump to said downstream portion of said one of said third and fourth conduit means and selectively permitting flow from said downstream portion of said one of said third and fourth conduit means to said sump, and means for selectively opening said let-down valve including a piston engageable with said let-down valve, and a duct communicating between said piston and said second conduit means and including therein valve means preventing flow to said second conduit means and permitting flow from said second conduit means to said piston in response to pressure in said second conduit means above a predetermined level.

2. A marine propulsion device in accordance with claim 1 and further including additional conduit means communicating between said first and second conduit means and including valve means for preventing flow from said second conduit means to said first conduit means and permitting flow from said first conduit means to said second conduit means in response to pressure in said first conduit means above a predetermined level.

3. A marine propulsion device in accordance with claim 1 wherein said let-down valve includes a first side adjacent to said piston and a second side remote from said piston, and wherein said downstream portion of said fourth conduit means communicates with said second side of said let-down valve and said sump communicates with said first side of said let-down valve.

4. A marine propulsion device in accordance with claim 1 wherein said fourth conduit means includes an additional portion communicating between said downstream portion and said sump and including a pressure relief valve preventing flow from said sump to said fourth conduit means and permitting flow from said fourth conduit means to said sump in response to pressure in said fourth conduit means above a predetermined amount.

5. A marine propulsion device in accordance with claim 1 wherein said third conduit means includes an additional portion communicating between said downstream portion thereof and said sump and including a pressure relief valve preventing flow from said sump to said third conduit means and permitting flow from said third conduit means to said sump in response to a pressure in said third conduit means above a predetermined amount.

6. A marine propulsion device in accordance with claim 1 and further including additional conduit means communicating between said second conduit means and said sump and including therein valve means preventing flow from said second conduit means to said sump and permitting flow from said sump to said second conduit means.

7. A marine propulsion device in accordance with claim 6 and further including second additional conduit means communicating between said third conduit means and said sump and including valve means permitting flow from said sump to said third conduit means and preventing flow from said third conduit means to said sump.

8. A marine propulsion device in accordance with claim 7 wherein said let-down valve includes a first side adjacent to said piston and a second side remote from said piston, and wherein said downstream portion of said fourth conduit means communicates with said second side of said let-down valve and said sump communicates with said first side of said let-down valve.

9. A marine propulsion device in accordance with claim 8 and further including an additional conduit extending between said second conduit means and said sump and including valve means preventing flow from said sump to said second conduit means and permitting flow from said second conduit means to said sump.

10. A marine propulsion device in accordance with claim 1 and further including fifth conduit means including fifth valve means communicating between said downstream portion of said third conduit means and said downstream portion of said fourth conduit means, said fifth valve means being operable to prevent fluid flow from said downstream portion of said third conduit means to said downstream portion of said fourth conduit means, and to permit fluid flow from said downstream portion of said fourth conduit means to said downstream portion of said third conduit means in response to the presence of fluid under pressure above a predetermined level in said downstream portion of said fourth conduit means.

11. A marine propulsion device comprising transom bracket means adapted to be connected to a boat transom, a stern bracket, first pivot means connecting said stern bracket to said transom bracket means for pivotal movement therebetween about a first pivot axis which is horizontal when said transom bracket means is boat mounted, a swivel bracket, second pivot means connecting said swivel bracket to said stern bracket for pivotal movement with said stern bracket and relative to said stern bracket about a second pivot axis parallel to said first pivot axis, a propulsion unit including, at the lower end thereof, a rotatably mounted propeller, means pivotally connecting said propulsion unit to said swivel bracket for steering movement relative to said swivel bracket and for common pivotal movement with said swivel bracket, a trim cylinder-piston assembly pivotally connected to said stern bracket and to said swivel bracket and including first and second ends, a tilt cylinder-piston assembly pivotally connected to said transom bracket means and to said stern bracket and including first and second ends, a reversible pump including first and second ports, first conduit means including first valve means communicating between said first pump port and said first end of said trim cyliner-piston assembly, second conduit means including second valve means communicating between said first pump port and said first end of said tilt cylinder-piston assembly, third conduit means including third valve means dividing said third conduit means into an upstream portion communicating with said second pump port and a downstream portion communicating with said second end of said trim cylinder-piston assembly, fourth conduit means including fourth valve means dividing said fourth conduit means into an upstream portion communicating with said second pump port and a downstream portion communicating with said second end of said tilt cylinder-piston assembly, and additional conduit means extending between said first and second conduit means and including valve means for preventing flow from said second conduit means to said first conduit means and permitting flow from said first conduit means to said second conduit means in response to pressure in said first conduit means above a predetermined level.

12. A marine propulsion device in accordance with claim 11 and further including fifth conduit means including fifth valve means communicating between said downstream portion of said third conduit means and said downstream portion of said fourth conduit means, said fifth valve means being operable to prevent fluid flow from said downstream portion of said third conduit means to said downstream portion of said fourth conduit means, and to permit fluid flow from said downstream portion of said fourth conduit means to said downstream portion of said third conduit means in response to the presence of fluid under pressure above a predetermined level in said downstream portion of said fourth conduit means.

* * * * *